US010655469B2

(12) United States Patent
Merk

(10) Patent No.: US 10,655,469 B2
(45) Date of Patent: May 19, 2020

(54) VANE HAVING SURFACES WITH DIFFERENT MATERIAL PROPERTIES IN A ROTARY PUMP

(71) Applicant: Schwäbische Hüttenwerke Automotive GmbH, Aalen-Wasseralfingen (DE)

(72) Inventor: Klaus Merk, Bad Wurzach (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 312 days.

(21) Appl. No.: 15/463,216

(22) Filed: Mar. 20, 2017

(65) Prior Publication Data

US 2017/0268508 A1 Sep. 21, 2017

(30) Foreign Application Priority Data

Mar. 21, 2016 (DE) ..... 10 2016 105 247

(51) Int. Cl.
*F01C 21/08* (2006.01)
*F04C 2/344* (2006.01)

(52) U.S. Cl.
CPC ..... *F01C 21/0809* (2013.01); *F04C 2/344* (2013.01); *F04C 2/3442* (2013.01); *F04C 2230/92* (2013.01)

(58) Field of Classification Search
CPC .. F01C 21/0809; F04C 2230/92; F04C 2/344; F04C 2/3442
See application file for complete search history.

(56) References Cited

U.S. PATENT DOCUMENTS 3,044,687 A 7/1962 Davey
3,398,884 A * 8/1968 Kaatz ..... F01C 21/0809 418/152
4,518,333 A 5/1985 Seki et al.
5,021,629 A * 6/1991 Shimomura ..... F01C 21/0809 219/121.47
5,672,054 A * 9/1997 Cooper ..... F01C 21/0809 418/178

(Continued)

FOREIGN PATENT DOCUMENTS

CN 202483876 U 10/2012
CN 104033380 A 9/2014

(Continued)

OTHER PUBLICATIONS

Chinese Office Action for Chinese Application No. 201710170731.4, dated Aug. 2, 2018, with translation, 19 pages.

(Continued)

*Primary Examiner* — Mary Davis
(74) *Attorney, Agent, or Firm* — RatnerPrestia

(57) ABSTRACT

A delivery element for a rotary pump is proposed which is formed in one part from a metallic material, wherein the delivery element includes at least one first surface and at least one second surface which differ from each other, at least in regions, in at least one material property. A method for manufacturing a delivery element in accordance with the invention, a rotary pump including at least one delivery element in accordance with the invention, and the use of a delivery element in accordance with the invention in a rotary pump is also proposed.

18 Claims, 2 Drawing Sheets

(56) References Cited

U.S. PATENT DOCUMENTS

| | | | | |
|---|---|---|---|---|
| 5,741,127 | A * | 4/1998 | Murayama | F01C 21/0809 29/888.025 |
| 6,032,720 | A * | 3/2000 | Riegger | F01C 21/0809 164/105 |
| 6,142,756 | A | 11/2000 | Hashimoto et al. | |
| 6,413,061 | B1 * | 7/2002 | Esumi | F01C 21/0809 148/220 |
| 9,163,633 | B2 | 10/2015 | Park | |
| 2009/0068049 | A1 | 3/2009 | Saito et al. | |
| 2009/0136374 | A1 | 5/2009 | Tsukahara et al. | |
| 2013/0287616 | A1 | 10/2013 | Guidry, Jr. | |
| 2015/0240806 | A1 | 8/2015 | Merk | |
| 2016/0177948 | A1 | 6/2016 | Braasch | |

FOREIGN PATENT DOCUMENTS

| | | | |
|---|---|---|---|
| CN | 104879299 | A | 9/2015 |
| DE | 3529106 | A1 | 2/1987 |
| DE | 10104222 | A1 | 8/2001 |
| DE | 102006033337 | A1 | 1/2008 |
| DE | 202014106121 | U1 | 1/2015 |
| JP | 11311188 | A | 11/1999 |
| WO | 9600852 | A1 | 1/1996 |
| WO | 0179659 | A1 | 10/2001 |
| WO | 2015045433 | A1 | 4/2015 |

OTHER PUBLICATIONS

German Search Report issued in application DE 10 2016 105 247.7 dated Dec. 13, 2016, 8 pages.

Extended European Search Report for European Application No. 17161121.3, dated Sep. 21, 2017, including partial English translation, 8 pages.

* cited by examiner

VANE HAVING SURFACES WITH DIFFERENT MATERIAL PROPERTIES IN A ROTARY PUMP

CROSS REFERENCE TO RELATED APPLICATIONS

This application claims priority to German Patent Application No. 10 2016 105 247.7, filed Mar. 21, 2016, the contents of such application being incorporated by reference herein.

FIELD OF THE INVENTION

The invention relates to a delivery element for a rotary pump, a method for manufacturing such a delivery element, a rotary pump comprising at least one such delivery element and the use of at least one such delivery element.

BACKGROUND OF THE INVENTION

DE 10 2006 033 337 A1 and DE 20 2014 106 121 U1, each incorporated by reference herein, respectively disclose a rotary pump comprising delivery elements. Forming the delivery elements in one part from a metallic material is also known.

SUMMARY OF THE INVENTION

An aspect of the invention is based in particular on reducing the cost of the rotary pump. An aspect of the invention is also based in particular on designing the manufacturing method, in particular for manufacturing a delivery element of the rotary pump, to be more robust and more cost-effective.

In accordance with an aspect of the invention, a delivery element for a rotary pump is proposed which is formed from a metallic material, preferably in one part, wherein the delivery element comprises at least one first, preferably metallic surface and at least one second, preferably metallic surface which differ from each other, at least in regions, in at least one material property. This enables a delivery element made of a metallic material to be provided which comprises at least two preferably metallic surfaces which are adapted to different demands or functions as compared to each other. The surfaces can be purposefully configured or adapted to their function and/or demands, thus in particular enabling an advantageous frictional pairing to be provided. In order to adapt or configure the surfaces, advantageous metallic materials and/or advantageous method steps and/or an advantageous order of the method steps can be chosen for manufacturing the delivery element, which enable the manufacturing costs and/or manufacturing tolerances to be reduced. By using such a delivery element in a rotary pump, it is possible to reduce the cost of the rotary pump. The difference in at least one material property is preferably knowingly and/or purposefully manufactured and/or introduced and in particular does not result from manufacturing tolerances.

Preferably, the at least one first surface and the at least one second surface differ from each other, at least in regions, in at least one physical material property.

The delivery element is preferably embodied in one part. The expression "in one part" is to be understood in particular to mean "shaped in one piece", such as for example by being separated from a blank or manufactured from a casting or metal powder. The delivery element advantageously does not comprise a coating applied as a material and is advantageously not joined together from multiple separately produced parts. The terms "first" and "second" are in particular intended to be used for distinguishing purposes and in particular do not represent an order, for example with regard to their arrangement, size, load exposure, machining or the like. The at least one first surface and the at least one second surface are preferably areas which are separate from each other. The at least one first surface and the at least one second surface are preferably separated from each other by at least one edge and/or by at least one third surface. The at least one first surface and the at least one second surface preferably adjoin each other directly if they are separated from each other by exactly one edge. The at least one first surface and the at least one second surface are preferably orientated at an angle to each other and are in particular orientated at least substantially perpendicularly with respect to each other if they adjoin each other directly. The at least one first surface and the at least one second surface preferably do not adjoin each other directly if they are separated from each other by more than one edge and/or by at least one third surface. The at least one first surface and the at least one second surface are preferably orientated at least substantially in parallel with each other and at a distance from each other if they do not adjoin each other directly. The expression "provided" is to be understood in particular to mean "specifically embodied, configured, fitted and/or arranged".

In order to reduce the manufacturing tolerances, it is proposed that the first surface and the second surface differ from each other, at least in regions, in at least a hardness and/or a density and/or a compressive residual stress. The at least two surfaces differ from each other in hardness and/or density and/or compressive residual stress by in particular at least 20%, advantageously by at least 30% and particularly advantageously by at least 40%. The difference in hardness and/or density and/or compressive residual stress preferably measures 50% at most.

If the surfaces differ in hardness, the harder of the at least two surfaces is preferably at most twice as hard as the softer of the at least two surfaces. The hardness is preferably embodied as a Vickers hardness, in particular in accordance with the DIN EN ISO 6507-1:2006-03 standard. The harder surface advantageously exhibits a Vickers hardness of at least 600HV10. The softer surface advantageously exhibits a Vickers hardness of at least 300HV10.

Preferably, the hardness and/or density and/or compressive residual stress of at least one of the surfaces is reduced in at least one method step, in particular latterly, i.e. preferably after a preceding method step in which the hardness and/or density and/or compressive residual stress is increased. In order to reduce the hardness and/or density and/or compressive residual stress, a method step can be chosen which additionally reduces inaccuracies and/or irregularities on the surface, thus enabling the hardness and/or density and/or compressive residual stress and the manufacturing tolerances to be reduced in a cost-effective way.

It is also proposed that the first surface and/or the second surface be formed by a surface layer which is harder and/or denser and/or exhibits a greater compressive residual stress than a core region which lies beneath the surface layer, thus enabling a delivery element to be provided which exhibits high durability in its interior and high wear resistance at its surfaces. The delivery element is preferably compacted and/or hardened and/or provided with a greater compressive residual stress on its surface only. The delivery element is preferably surface-hardened, advantageously nitrided and particularly advantageously gas-nitrided. Alternatively, the delivery element is surface-compacted, advantageously surface-deformed or surface-moulded. The surface can for example be compacted by re-compacting a powder-metallurgical delivery element, for example by deforming the surface. In another alternative, the delivery element is treated using compression blasting (shot peening), in particular grit blasting. Using compression blasting, compressive residual stresses are preferably introduced into or induced in the surface of the delivery element. A "surface layer" is to be understood in particular to mean a layer of the metallic material which results from a change in the lattice structure and/or the arrangement of the metallic material, such as for example by diffusing substances such as nitrogen into it, by compacting the material, by changing the surface stress and/or the like. The surface layer is in particular not a covering of the metallic material and therefore not a coating. The core region and the surface layer are preferably made of the same metallic material.

In order to provide two surfaces which differ from each other in a hardness, the hardening method for hardening the first surface can differ from the hardening method for hardening the second surface, such as for example in the manner of the hardening method and/or by parameters of the hardening method. For powder-metallurgical delivery elements, for example, the moulding pressure on the first surface can differ from the moulding pressure on the second surface and/or the material allowance of the delivery element blank relative to the die used to deform the first surface can differ from the material allowance of the delivery element blank relative to the die used to deform the second surface:

It is also proposed that the surface layer forming the first surface be harder and/or denser and/or exhibits a greater compressive residual stress, at least in regions, than the surface layer forming the second surface, thus enabling a scenario to be realised in which the second surface exhibits a lesser hardness and/or a lower density and/or a lower compressive residual stress than the first surface and a greater hardness and/or a greater density and/or a greater compressive residual stress than the core region. This enables a surface to be provided which exhibits low manufacturing tolerances and a sufficiently high wear resistance. Preferably, the first surface is embodied as the harder and/or denser surface and/or the surface exhibiting a greater compressive residual stress and the second surface is embodied as the softer surface and/or the surface exhibiting a lower density and/or a lower compressive residual stress.

It is in particular advantageous if the surface layer forming the second surface is thinner than the surface layer forming the first surface, thus enabling the manufacture of a surface which exhibits low manufacturing tolerances and a sufficiently high wear resistance to be simplified. Preferably, the surface layer forming the second surface is mechanically ablated at least partially, thus enabling the hardness and/or the density and/or the compressive residual stress and inaccuracies in the surface resulting from a hardening process and/or a compacting process and/or a compressive residual stress inducing process to be reduced in just one method step.

The delivery element preferably exhibits a smaller nitriding hardness depth (NHD) on the second surface than on the first surface. The first surface advantageously comprises a connecting layer formed by diffusing nitrogen or carbon into it (ε and γ' iron nitrides). The second surface preferably lacks a connecting layer formed by diffusing nitrogen or carbon into it (ε and γ' iron nitrides). The connecting layer formed by diffusing nitrogen or carbon into it (ε and γ' iron nitrides) is preferably ablated on the second surface.

In order to reduce cost, the delivery element can comprise at least one surface embodied as a drawn surface, thus enabling at least one machining step, in particular a formative machining step, to be omitted following a drawing process. A process of grinding, in particular formatively grinding, a surface resulting from the drawing process is preferably omitted when manufacturing the delivery element, whereby said surface is or remains embodied as a drawn surface. The surface embodied as a drawn surface is advantageously embodied, in particular in its shape and/or dimensions, at least substantially such as it results from the drawing process. It is however in principle conceivable to machine, in particular slide-grind, the surface embodied as a drawn surface, whereby the embodiment of the surface as a drawn surface is at least substantially not impaired. It is in principle conceivable to machine the surface embodied as a drawn surface in at least one machining step following the drawing process, in which the shape and/or dimensions of the surface embodied as a drawn surface which result from the drawing process are at least substantially not changed. The surface embodied as a drawn surface preferably enables a surface to be provided or obtained which exhibits flaws, caused by the drawing process, which can function as lubricating pockets, thus enabling friction on the surface to be kept low. By omitting the process of machining, in particular grinding, the surface embodied as a drawn surface, it is advantageously possible to prevent pocket-shaped flaws on said surface, caused by the drawing process, from being removed or reduced. The surface embodied as a drawn surface is preferably embodied as a drawing surface, the shape and/or dimensions of which advantageously result at least substantially from the drawing process. In the drawing process, a delivery element blank is preferably drawn through a drawing die, in particular a formative drawing die, or the drawing die is drawn over the delivery element blank. The surface embodied as a drawn surface, in particular its shape and/or dimensions, preferably result at least primarily from plastic reshaping or deforming.

In order to reduce the manufacturing costs, it is also advantageous if the delivery element comprises at least one curved surface, the curvature of which results at least substantially from a drawing process, thus enabling a grinding process, in particular a radius grinding process, to be omitted when manufacturing the delivery element. This also enables a surface to be provided or obtained which exhibits flaws, caused by drawing, which can function as lubricating pockets, thus enabling friction on the surface to be kept low. By omitting the grinding process, in particular the radius grinding process, it is possible to prevent pocket-shaped flaws on the surface, caused by drawing, from being removed or reduced.

It is also advantageous if the second surface is embodied as a housing sliding surface which is provided in order to slide on a delivery element running surface of a housing base or housing cover of the rotary pump, thus enabling a particularly exact housing sliding surface to be provided. The first surface is preferably embodied as a rotor sliding surface which is provided in order to slide on a lateral sliding surface of a rotor slot or as a setting element sliding surface which is provided in order to slide on a delivery element running surface of a setting element of the rotary pump.

It is also proposed that the metallic material be a tempering steel, thus enabling a particularly advantageous material to be chosen for the delivery element. It is in particular advantageous if the metallic material is alloyed with chromium, molybdenum and vanadium. The metallic material is preferably a nitriding steel alloyed with chromium, molybdenum and vanadium. The nitriding steel advantageously exhibits a carbon content of between 0.26 and 0.34% and exhibits an alloy component of chromium of between 2.3 and 2.7% and an alloy component of molybdenum of between 0.15 and 0.25% and an alloy component of vanadium of between 0.1 and 0.2%.

In order to provide a powder-metallurgical delivery element which comprises at least two surfaces which differ from each other in their hardness and/or density, it is proposed that only one of the surfaces be re-compacted or that the at least two surfaces be re-compacted to differing degrees. For a powder-metallurgically manufactured delivery element, it is proposed that only selected surfaces of the powder-metallurgical delivery element be re-compacted or that the surfaces of the powder-metallurgical delivery element be re-compacted to differing degrees. The powder-metallurgical delivery element can thus comprise re-compacted surfaces and non-re-compacted surfaces. Re-compacting can for example be performed by way of the material allowance of the delivery element blank relative to a die which deforms and compacts the surface to be compacted as it is pressed through. Re-compacting can also be performed by way of roller-burnishing, wherein the powder-metallurgical delivery element can comprise surfaces embodied as drawn surfaces and/or ground surfaces.

In order to provide a metallic delivery element which comprises at least two surfaces which differ from each other in their compressive residual stress, it is proposed that only one of the surfaces be treated using compression blasting or that the at least two surfaces be treated using compression blasting to differing degrees. For a metallic delivery element, it is proposed that only selected surfaces of the delivery element be treated using compression blasting or that the surfaces of the delivery element be treated using compression blasting to differing degrees. The delivery element can thus comprise blasted surfaces and non-blasted surfaces. In order to treat the surfaces using compression blasting to differing degrees, the blasting parameters such as the impact angle, blasting time, blasting pressure, discharge velocity of the blasting material, type of blasting material and/or degree of coverage can be different, wherein the delivery element can comprise surfaces embodied as drawn surfaces and/or ground surfaces.

It is particularly advantageous if the delivery element is embodied as a vane for a vane cell pump, thus enabling a particularly cost-effective vane cell pump to be provided. It is in principle also conceivable for the delivery element to be embodied as a toothed wheel for a toothed wheel pump or a pendulum for a reciprocating piston valve pump or the like.

In order to provide a particularly advantageous delivery element, a delivery element is proposed which comprises: two hard surfaces embodied as ground surfaces; two hard surfaces embodied as drawn surfaces; and two soft surfaces embodied as ground surfaces. Also advantageous is a delivery element which comprises: two hard surfaces embodied as ground surfaces; instead of two hard surfaces embodied as drawn surfaces, two hard surfaces embodied as ground surfaces; and two soft surfaces embodied as ground surfaces. In this context, a "hard surface" is to be understood in particular to mean a surface which is harder than the core region and/or harder than the soft surface. In this context, a "soft surface" is to be understood in particular to mean a surface which is harder than or equally hard as the core region and softer than the hard surface.

A method for manufacturing a delivery element for a rotary pump of a motor vehicle, in particular a delivery element in accordance with the invention, is also proposed, wherein a delivery element blank formed from a metallic material is firstly surface-hardened or surface-compacted or surface-reinforced and the hardened or compacted or reinforced surface layer is then at least partially ablated on at least one surface of the delivery element blank. By ablating the hardened or compacted or reinforced surface layer, it is possible to reduce inaccuracies on the surface resulting from surface-hardening or surface-compacting or surface-reinforcing, thus enabling the manufacturing tolerances to be reduced and a sufficiently high wear resistance to be obtained. The delivery element manufactured in this way thus comprises a surface which exhibits low manufacturing tolerances and a lesser hardness and/or a lower density and/or a lower compressive residual stress than at least one other surface. Due to the surface-hardening or surface-compacting or surface-reinforcing, the delivery element comprises a surface layer which is harder and/or denser and/or exhibits a greater compressive residual stress than a core region which lies beneath the surface layer.

The delivery element or delivery element blank preferably consists of a tempering steel. The delivery element or delivery element blank is advantageously alloyed with chromium, molybdenum and vanadium. The delivery element or delivery element blank preferably consists of a nitriding steel alloyed with chromium, molybdenum and vanadium. The nitriding steel advantageously exhibits a carbon content of between 0.26 and 0.34% and exhibits an alloy component of chromium of between 2.3 and 2.7% and an alloy component of molybdenum of between 0.15 and 0.25% and an alloy component of vanadium of between 0.1 and 0.2%.

The delivery element is advantageously surface-hardened by being nitrided, in particular gas-nitrided. The nitriding hardness depth (NHD) is preferably reduced by ablating the hardened surface layer. By ablating the hardened surface layer, a connecting layer formed by diffusing nitrogen or carbon into it ($\varepsilon$ and $\gamma'$ iron nitrides) is advantageously at least partially ablated.

It is in particular advantageous for the method if the delivery element blank is ground, in particular after the hardening process and therefore after the surface-hardening or surface-compacting or surface-reinforcing, in order to ablate the hardened and/or compacted and/or reinforced surface layer, thus enabling the hardened and/or compacted and/or reinforced surface layer to be ablated in a cost-effective way. The delivery element blank is preferably ground on its surfaces which define its main extent, in order to ablate the hardened and/or compacted and/or reinforced surface layer, thus enabling a scenario to be realised in which the delivery element exhibits particularly low manufacturing tolerances along its main extent. The main extent of the fitted delivery element is preferably orientated in parallel with a rotary axis of a delivery rotor of the rotary pump.

In order to save on manufacturing costs, it is proposed for the method that the delivery element blank is deformed, in particular plastically, in a drawing process before the hardening process in order to provide at least one surface embodied as a ground surface, wherein a subsequent process of grinding the surface embodied as a ground surface is omitted. Preferably, a formative process of grinding the surface embodied as a ground surface is omitted. The delivery element blank comprising the at least one surface embodied as a drawn surface, the shape and/or dimensions and in particular the radius of which result at least primarily from the drawing process and advantageously are at least substantially not changed by machining, is used as the delivery element. It is in principle conceivable for the surface embodied as a drawn surface to be slide-ground and/or demagnetised.

It is also advantageous for the method if a process of grinding, in particular radius grinding, a curved surface of the delivery element blank is omitted. By omitting the grinding process, in particular the radius grinding process, the curvature of a curved surface results at least substantially from a drawing process.

A rotary pump for a motor vehicle, in particular a vane cell pump, comprising at least one delivery element in accordance with an aspect of the invention is also proposed, thus enabling the cost of the rotary pump to be reduced. The rotary pump is preferably embodied as a lubricating oil pump of a motor vehicle engine or motor vehicle transmission.

The use of the delivery element in accordance with an aspect of the invention in a rotary pump, in particular a vane cell pump, of a motor vehicle is also proposed.

BRIEF DESCRIPTION OF THE DRAWINGS

Other advantages follow from the following description of the figures. An example embodiment of the invention is shown in the figures. The figures, description and claims contain numerous features in combination. The person skilled in the art will also expediently consider the features individually and combine them to form other expedient combinations.

DETAILED DESCRIPTION OF THE INVENTION

Figure 1:
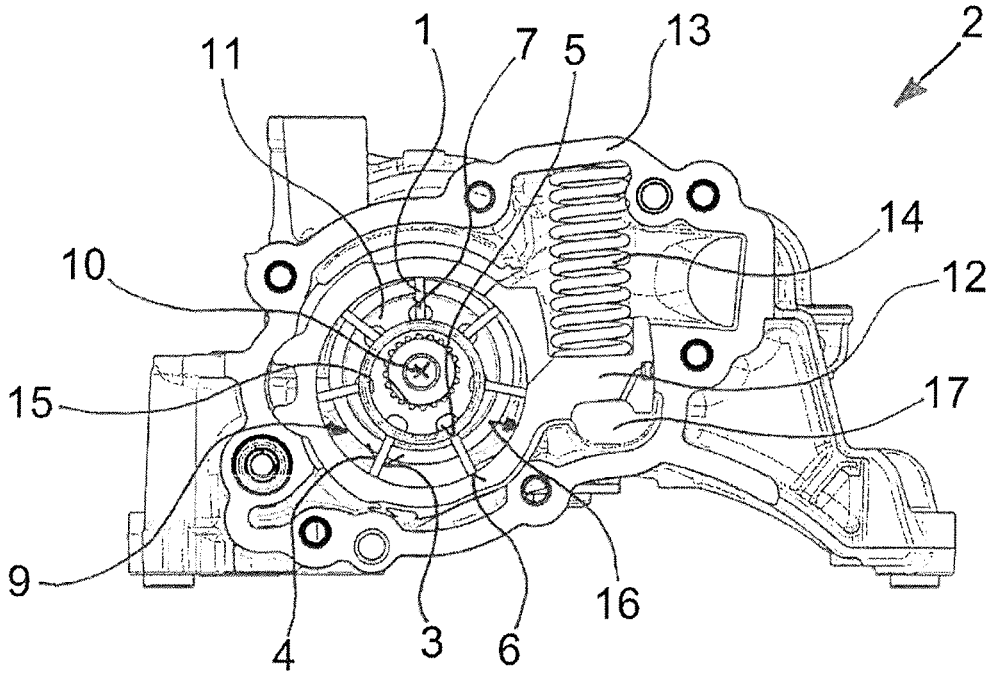
FIG. 1 shows a rotary pump with the housing cover disassembled, comprising multiple delivery elements in accordance with the invention.

FIG. 1 shows a rotary pump 2 of a motor vehicle. The rotary pump 2 is provided in order to deliver an operational fluid. The operational fluid is embodied as a lubricant and/or coolant. In this example embodiment, the operational fluid is embodied as an engine lubricating oil. The rotary pump 2 is assigned to a combustion engine of the motor vehicle. The rotary pump 2 is embodied as a vane cell pump. The operational fluid can in principle also be embodied as an actuating means. The rotary pump 2 can in principle be assigned to a transmission of the motor vehicle.

In order to deliver the operational fluid, the rotary pump 2 comprises a delivery rotor 9 which rotates about a rotary axis 10 when the rotary pump 2 is in operation. The delivery rotor 9 comprises a rotor structure 11, which is central with respect to the rotary axis 10, and delivery elements 1 which are arranged in a distribution over the circumference of the rotor structure 11. The rotor structure 11 comprises multiple rotor slots in order to accommodate the delivery elements 1 in such a way that they can be shifted. One delivery element 1 is respectively arranged, such that it can be shifted, in each rotor slot.

In order to adjust a delivered amount of operational fluid while the rotary pump 2 is in operation, the rotary pump 2 comprises an adjustable setting element 12. The setting element 12 surrounds the delivery rotor 9. The setting element 12 comprises a delivery element running surface 16 which faces the delivery rotor 9. The delivery elements 1 contact and slide on the delivery element running surface 16. The delivery rotor 9 and the setting element 12 are arranged eccentrically with respect to each other. In order to adjust the eccentricity and therefore the delivered amount, the setting element 12 is arranged such that it can be pivoted. The setting element 12 is embodied as a setting ring. In order to adjust the eccentricity and therefore the delivered amount, the setting element 12 can in principle be arranged such that it can be axially shifted. The setting element 12 can in principle be embodied as a setting piston.

In order to shift the delivery elements 1 out of the rotor slot, perpendicularly with respect to the rotary axis 10, in accordance with the rotational position, the rotary pump 2 comprises a supporting element 15 which directly contacts the delivery elements 1. The supporting element 15 is provided in order to press the delivery elements 1 against the delivery element running surface 16 of the setting element 12. The supporting element 15 is embodied as a supporting ring.

The rotary pump 2 also comprises a housing 13. The delivery rotor 9 and the setting element 12 are arranged within the housing 13. The housing 13 comprises a housing base and a housing cover. Lateral walls axially protrude in one part out of the housing base in the direction of the housing cover with respect to the rotary axis 10. The housing cover is not shown in FIG. 1, such that the functional components of the rotary pump 2 are visible. The housing base and the housing cover each comprise a delivery element running surface 16 which faces the delivery rotor 9. The delivery elements 1 contact and slide on the delivery element running surface 16 of the housing base and the delivery element running surface 16 of the housing cover. The housing base, the housing cover and the setting element 12 enclose a delivery chamber within the setting element 12, in which the operational fluid is delivered from a suction side to a pressure side by the delivery elements 1 while the rotary pump 2 is in operation.

The housing 13 and the setting element 12 enclose at least one hydraulic setting chamber 17 outside the setting element 12. A hydraulic pressure, which acts on the setting element 12 in order to adjust the eccentricity and therefore the delivered amount, can be built up in the at least one setting chamber 17 while the rotary pump 2 is in operation. The pressure in the at least one setting chamber 17 acts in the direction of less eccentricity and therefore a lower delivered amount.

In order to restore the setting element 12, the rotary pump 2 comprises a spring element 14 which is functionally connected to the setting element 12. The spring element 14 acts counter to the hydraulic pressure in the at least one setting chamber 17 and therefore counter to a setting force which acts on the setting element 12 and results from the pressure in the at least one setting chamber 17. The spring element 14 is embodied as a restoring spring or a regulating spring. It acts as a pressure spring. In this example embodiment, the spring element 14 is embodied as a helical spring.

The delivery elements 1 are embodied as single-part vanes. The delivery elements 1 are formed entirely from a metallic material. The delivery elements 1 are produced from a single metallic material. They are formed from a tempering steel. The material of the delivery elements 1 is a nitriding steel alloyed with chromium, molybdenum and vanadium. In this example embodiment, the delivery element 1 is made of the material 31CrMoV9. The delivery elements 1 are embodied similarly to each other, for which reason only one of the delivery elements 1 is described in more detail in the following. The delivery elements 1 do not comprise a coating produced by being applied and are in this sense uncoated.

Figure 2B:
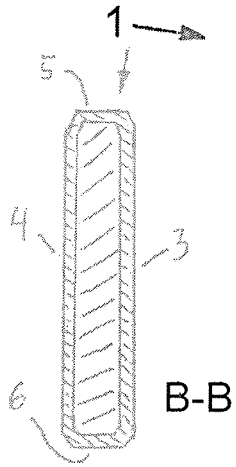
FIGS. 2A and 2B show one of the delivery elements in accordance with the invention.
Figure 2A:
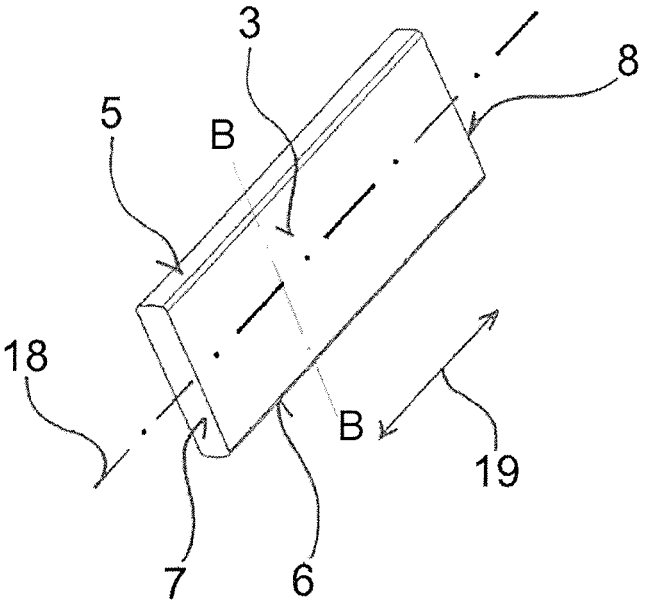

FIGS. 2A and 2B show the delivery element 1 in a perspective view and cross-section. The delivery element 1 comprises six surfaces 3, 4, 5, 6, 7, 8. Each two of the surfaces 3, 4, 5, 6, 7, 8 are orientated in parallel with each other. Each two surfaces 3, 4, 5, 6, 7, 8 which are orientated in parallel with each other respectively face away from each other. The two surfaces 3, 4 which are orientated in parallel with each other exhibit the largest area as compared to the other surfaces 5, 6, 7, 8. The two surfaces 5, 6 which are orientated in parallel with each other are embodied as curved surfaces. The two surfaces 5, 6 are convex. The curvature of the surfaces 5, 6 results substantially from a drawing process. In the drawing process, the delivery element 1 can be plastically deformed, thus creating the surfaces 5, 6 embodied as drawn surfaces. The two surfaces 7, 8 which are orientated in parallel with each other are embodied as axially facing surfaces. The delivery element 1 exhibits a main extent 19 which is orientated in parallel with the rotary axis 10 when the delivery element 1 is fitted in the rotary pump 2. The main extent 19 is the largest extent of the delivery element 1. The two surfaces 7, 8 define the main extent 19 of the delivery element 1. A distance between the two surfaces 7, 8 which are orientated in parallel with each other corresponds to the main extent 19. The four surfaces 3, 4, 5, 6 together form a shell surface of the delivery element 1. The shell surface extends around a centre axis 18 of the delivery element 1 which is orientated in parallel with the main extent 19. The two surfaces 7, 8 form a base surface and covering surface, respectively. The base surface and covering surface are orientated perpendicularly with respect to the centre axis 18. The surfaces 3, 4, 5, 6 are each orientated in parallel with the main extent 19. The surfaces 7, 8 are each orientated perpendicularly with respect to the main extent 19. The delivery element 1 is embodied as a cuboid.

The surfaces 3, 4, 5, 6, 7, 8 are each embodied as a friction surface or a sliding surface. The two surfaces 3, 4 are each embodied as a rotor sliding surface. They are provided in order to slide on a lateral sliding surface of the rotor slot when arranged in the rotor slot of the rotor structure 11. When the delivery element 1 is fitted, the two surfaces 3, 4 point in the circumferential direction of the rotor structure 11.

The surface 5 is embodied as a supporting surface. It contacts the supporting element 15 when the delivery element 1 is fitted. The delivery element 1 is supported on the supporting element 15 at the surface 5. When the delivery element 1 is fitted, the surface 5 points in the radial direction of the rotor structure 11. The surface 5 points perpendicularly with respect to the rotary axis 10 when the delivery element 1 is fitted. It faces the rotary axis 10.

The surface 6 is embodied as a setting element sliding surface. It contacts the setting element 12 when the delivery element 1 is fitted. The surface 6 is provided in order to slide on the delivery element running surface 16 of the setting element 12 when the delivery element 1 is fitted. When the delivery element 1 is fitted, the surface 6 points in the radial direction of the rotor structure 11. The surface 6 points perpendicularly with respect to the rotary axis 10 when the delivery element 1 is fitted. It faces away from the rotary axis 10.

The two surfaces 7, 8 are each embodied as a housing sliding surface. The surface 7 contacts the housing cover when the delivery element 1 is fitted. It is provided in order to slide on the delivery element running surface of the housing cover when the delivery element 1 is fitted. When the delivery element 1 is fitted, the surface 7 points in the axial direction of the rotor structure 11. The surface 7 points in parallel with the rotary axis 10 when the delivery element 1 is fitted. It faces the housing cover.

The surface 8 contacts the housing base when the delivery element 1 is fitted. It is provided in order to slide on the delivery element running surface of the housing base when the delivery element 1 is fitted. When the delivery element 1 is fitted, the surface 8 points in the axial direction of the rotor structure 11. The surface 8 points in parallel with the rotary axis 10 when the delivery element 1 is fitted. It faces the housing base.

The delivery element 1 is surface-hardened. The delivery element 1 harder on the surfaces 3, 4, 5, 6, 7, 8 than in its core. The surfaces 3, 4, 5, 6, 7, 8 are each formed by a surface layer which is harder than a core region of the delivery element 1 which lies beneath the surface layer. The delivery element 1 is nitrided. It is gas-nitrided. The surfaces 3, 4, 5, 6 differ from the surfaces 7, 8 in a physical material property. The physical material property by which the surfaces 3, 4, 5, 6 differ from the surfaces 7, 8 is embodied as a hardness, in particular a Vickers hardness. The surfaces 3, 4, 5, 6 are harder than the surfaces 7, 8. The shell surface of the delivery element 1 is harder than the base surface and/or covering surface of the delivery element 1. The surfaces 3, 4, 5, 6 exhibit a Vickers hardness HV10 of more than 600. The surfaces 7, 8 exhibit a Vickers hardness HV10 of more than 300. The Vickers hardness HV10 of the surfaces 7, 8 is less than 600, in particular less than 500. The core and the surface layers are made of the same metallic material. The delivery element 1 can also be surface-compacted, in particular when the delivery element 1 is embodied as a powder-metallurgical delivery element. It is also conceivable for the delivery element 1 to exhibit induced compressive residual stresses on at least one of the surfaces 3, 4, 5, 6, 7, 8, whereby the surfaces 3, 4, 5, 6, 7, 8 exhibit greater compressive residual stresses than the core.

The surface layer forming the surfaces 3, 4, 5, 6 is harder than the surface layer forming the surfaces 7, 8. The surface layer forming the surfaces 7, 8 is partially ablated. The surface layer forming the surfaces 7, 8 is thinner than the surface layer forming the surfaces 3, 4, 5, 6.

The nitriding hardness depth (NHD) on the surfaces 7, 8 is respectively less than the nitriding hardness depth (NHD) on the surfaces 3, 4, 5, 6. The surfaces 3, 4, 5, 6 each comprise a connecting layer formed by diffusing nitrogen or carbon into it (ε and γ' iron nitrides). The surfaces 7, 8 lack such a connecting layer formed by diffusing nitrogen or carbon into it (ε and γ' iron nitrides). The connecting layer formed by diffusing nitrogen or carbon into it (ε and γ' iron nitrides) is mechanically ablated on the surfaces 7, 8.

FIG. 2B shows a cut through the delivery element 1 along the line B-B. As can be seen, the delivery element 1 is made of a metallic material and comprises a core and surfaces 3, 4, 5, 6, 7, 8 which are treated, e.g. surface hardened. Thus, the surfaces 3, 4, 5, 6, 7, 8 differ from the core in a physical material property, e.g. hardness, wherein in the illustrated example the surfaces 3, 4, 5, 6 comprise a same physical material property, while surfaces 7, 8 forming axial front edges of the delivery element 1, comprise a different physical material property than the surfaces 3, 4, 5, 6.

Figure 3:
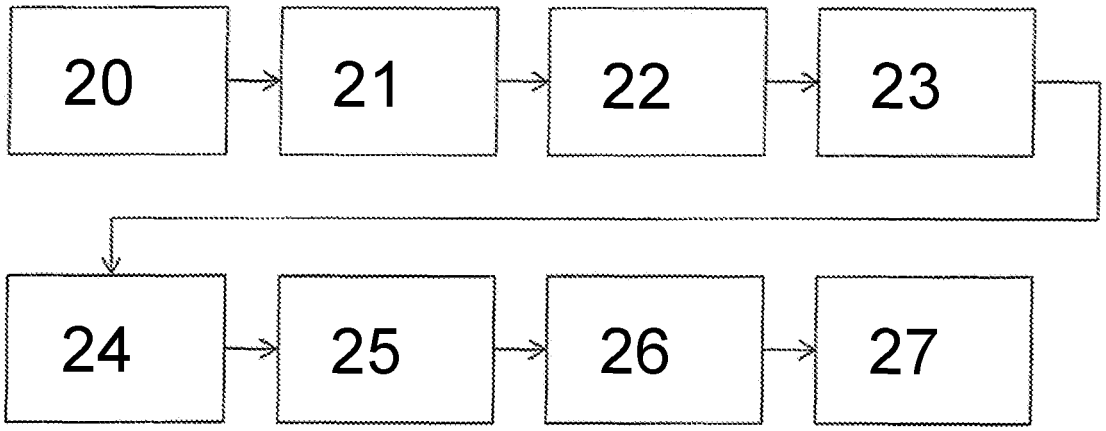
FIG. 3 schematically shows a method sequence for manufacturing the delivery element in accordance with the invention.

FIG. 3 schematically shows a method sequence for manufacturing the delivery element 1. The method for manufacturing the delivery element 1 comprises at least three method steps 20, 26, 27. The method advantageously comprises at least one other method step 21, 22, 23, 24, 25. The at least one method step 21, 22, 23, 24, 25 is performed after method step 20 and before method steps 26, 27. In this example embodiment, the method for manufacturing the delivery element 1 comprises multiple method steps 21, 22, 23, 24, 25 between method steps 20, 26, 27. It comprises at least five method steps 21, 22, 23, 24, 25 between method steps 20, 26, 27.

In method step 20, a delivery element blank is separated from a metallic material profile at the surfaces 7, 8 by way of a separating process. The separating process in method step 20 is embodied as an adiabatic separating process. Following method step 20, the delivery element blank is slide-ground in method step 21. Following method step 21, the delivery element blank is tempered in method step 22. Following method step 22, the delivery element blank is ground on its surfaces 3, 4 in method step 23. Following method step 23, the delivery element blank is slide-ground and demagnetised in method step 24. Following method step 24, the delivery element blank is washed in method step 25.

Following method step 25, the delivery element blank is surface-hardened in method step 26, thus creating a hardened surface layer on the surfaces 3, 4, 5, 6, 7, 8. Beneath the hardened surface layer, the delivery element blank comprises a core region which is softer than the surface layer. In method step 26, the delivery element blank is gas-nitrided for the purpose of surface-hardening.

Following method step 26, the hardened surface layer is mechanically ablated partially, on the two surfaces 7, 8 only, in method step 27. The hardened delivery element blank is ground on the surfaces 7, 8 in method step 27, in order to ablate the hardened surface layer. In method step 27, the hardened delivery element blank is ground on its surfaces 7, 8 which define its main extent 19, thus partially ablating the hardened surface layer on the surfaces 7, 8. In method step 27, the nitriding hardness depth (NHD) on the surfaces 7, 8 is reduced by ablating the hardened surface layer. By ablating the hardened surface layer, a connecting layer formed by diffusing nitrogen or carbon into it ($\varepsilon$ and $\gamma'$ iron nitrides) is mechanically ablated on the surfaces 7, 8.

Following method step 27, the delivery element 1 is in principle ready for use. A process of grinding, in particular radius grinding, the curved surfaces 5, 6 of the delivery element blank is omitted. At least one other method step, such as for example a gauging process, can in principle follow method step 27.

Figure 4:
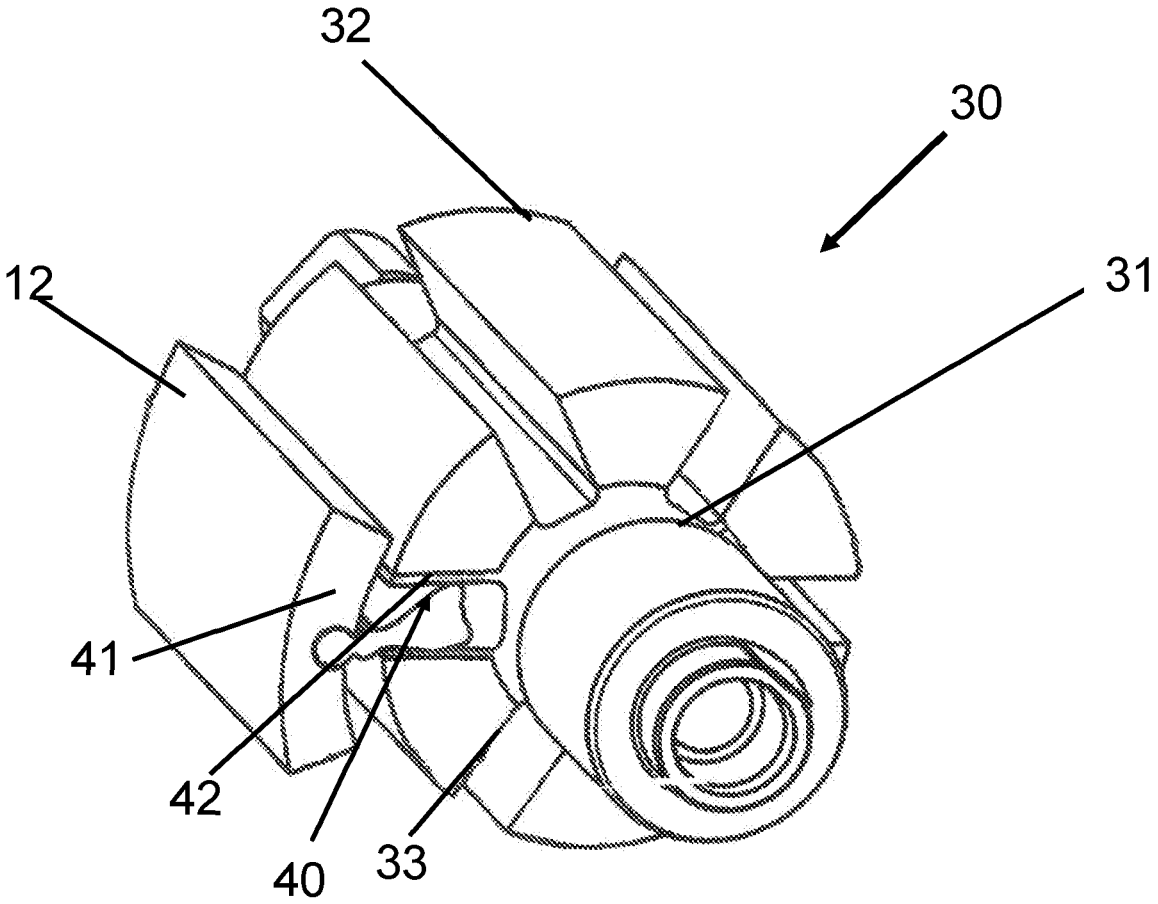
Figure 4 Prior Art
FIG. 4 shows a rotor of a well-known pendulum slider pump and a part of the setting element.

FIG. 4 illustrates a rotor 30 of a well-known pendulum slider pump and a part of the setting element 12. A pendulum 40 comprises a pendulum head 41 which is moveably fixed at the setting element 12 and a pendulum body 42 which extends into a slot 33 of the rotor 30. The rotor 30 comprises a plurality of slots 33 and a plurality of lands 32 between two adjacent slots 33. The lands 32 form a radial outer surface of the rotor 30. The rotor 30 comprises further a drive shaft 31 which connects the rotor 30 with a motor or a crankshaft of a combustion engine of a vehicle. The pendulum 40 is preferably embodied in one part, formed from a metallic material and treated to comprise at least one first metallic surface and at least one second metallic surface, wherein the at least one first metallic surface differs from the at least one second metallic surface in at least one material property, such as in hardness. Thus, the pendulum 40 comprises at least two metallic surfaces which are adapted to different demands or functions, e.g. such as wear resistance and/or improved sliding characteristics.

The pendulum 40 is a delivery element 1 as described before. Thus, all features described for the delivery element 1, and the methods used to accomplish the at least one first metallic surface and the at least one second metallic surface on the delivery element 1 apply—mutatis mutandis—to the pendulum 40.

LIST OF REFERENCE SIGNS

1 delivery element
2 rotary pump
3 surface
4 surface
5 surface
6 surface
7 surface
8 surface
9 delivery rotor
10 rotary axis
11 rotor structure
12 setting element
13 housing
14 spring element
15 supporting element
16 delivery element running surface
17 setting chamber
18 centre axis
19 main extent
20 method step
21 method step
22 method step
23 method step
24 method step
25 method step
26 method step
27 method step
30 rotor
31 drive shaft
32 lands
33 slots
40 pendulum
41 pendulum head
42 pendulum body

The invention claimed is:

1. A delivery element for a rotary pump, which delivery element is formed from an uncoated, surface-hardened metallic material, wherein the delivery element comprises at least one first uncoated metallic surface and at least one second uncoated metallic surface, wherein a hardened surface layer of the at least one second uncoated metallic surface is ablated at least partially, so that the at least one first uncoated metallic surface and the at least one second uncoated metallic surface differ from each other, at least in regions, in at least one material property, and wherein the delivery element is one of a vane of a vane pump and a pendulum of a pendulum slider pump.

2. The delivery element according to claim 1, wherein the at least one first uncoated metallic surface and the at least one second uncoated metallic surface differ from each other, at least in regions, in at least one of a hardness, a density, and a compressive residual stress.

3. The delivery element according to claim 2, wherein the at least one first uncoated metallic surface and/or the at least one second uncoated metallic surface are formed by a surface layer which is at least one of harder, denser, and exhibits a greater compressive residual stress than a core region which lies beneath the surface layer.

4. The delivery element according to claim 1, wherein the at least one first uncoated metallic surface and/or the at least one second uncoated metallic surface are formed by a surface layer which is at least one of harder, denser, and exhibits a greater compressive residual stress than a core region which lies beneath the surface layer.

5. The delivery element according to claim 4, wherein the surface layer forming the at least one first uncoated metallic surface is at least one of harder, denser, and exhibits a greater compressive residual stress, at least in regions, than the surface layer forming the at least one second uncoated metallic surface.

6. The delivery element according to claim 5, wherein the surface layer forming the at least one second uncoated metallic surface is thinner than the surface layer forming the at least one first uncoated metallic surface.

7. The delivery element according to claim 4, wherein the surface layer forming the at least one second uncoated metallic surface is thinner than the surface layer forming the at least one first uncoated metallic surface.

8. The delivery element according to claim 1, comprising:

at least one curved surface, the curvature of which results at least substantially from a drawing process.

9. The delivery element according to claim 1, wherein metallic material is a tempering steel.

10. The delivery element according to claim 1, wherein the metallic material is alloyed with chromium, molybdenum and vanadium.

11. The delivery element according to claim 1, wherein the delivery element is embodied the vane of the vane cell pump.

12. A method for manufacturing the delivery element according to claim 1 for a rotary pump of a motor vehicle, wherein a delivery element blank formed from the metallic material is surface-hardened, and wherein the hardened surface layer is then at least partially ablated on at least one surface of the delivery element blank.

13. The method according to claim 12, wherein the delivery element blank is ground in order to ablate the hardened surface layer.

14. The method according to claim 13, wherein the delivery element blank is ground on its surfaces which define its main extent, in order to ablate the hardened surface layer.

15. The method according to claim 12, wherein the delivery element blank is ground on its surfaces which define its main extent, in order to ablate the hardened surface layer.

16. The method according to claim 12, wherein a process of grinding a curved surface of the delivery element blank is omitted.

17. A rotary vane cell pump for a motor vehicle, comprising at least one delivery element according to claim 1.

18. A rotary pump comprising:

a housing, an axial housing cover, a rotor rotatable around a rotary axis, wherein the rotor comprises the delivery element according to claim 1, and wherein at least one second uncoated metallic surface of the delivery element is embodied as a housing sliding surface provided to slide on a delivery element running surface of the housing or the housing cover of the rotary pump.

* * * * *